United States Patent [19]

Bunk

[11] Patent Number: 4,815,428

[45] Date of Patent: Mar. 28, 1989

[54] ROTARY VALVE INTERNAL COMBUSTION ENGINE

[76] Inventor: Paul H. Bunk, 1738 Welling, Troy, Mich. 48098

[21] Appl. No.: 140,214

[22] Filed: Dec. 31, 1987

[51] Int. Cl.[4] ..... F01L 7/00

[52] U.S. Cl. ..... 123/190 BD; 123/190 A

[58] Field of Search ..... 123/190 BD, 190 B, 190 A, 123/151

[56] References Cited

U.S. PATENT DOCUMENTS

| | | | |
|---|---|---|---|
| 4,077,382 | 3/1978 | Gentile | 123/190 A |
| 4,418,658 | 12/1983 | Di Ross | 123/190 A |
| 4,473,041 | 9/1984 | Lyons et al. | 123/190 A |
| 4,545,337 | 10/1985 | Lyons et al. | 123/190 A |

*Primary Examiner*—E. Rollins Cross

*Attorney, Agent, or Firm*—Remy J. VanOphem

[57] ABSTRACT

A drum type rotary valve aspiration control for an internal combustion engine having a single, perpendicularly oriented rotary valve for each cylinder. An intake port and an exhaust port are provided, one on either side of the rotary valve along its cylindrical axis. The cylindrical surface of the rotary valve has an aperture for each of the intake and exhaust aspiration functions. The rotary valve has separate internal chambers. One chamber, having an intake port, communicates with the intake aperture, while the other chamber, having an exhaust port, communicates with the exhaust aperture. A structure is also provided within the rotary valve for threadably retaining a spark plug and for permitting selective communication between the spark plug and the cylinder port. A spark plug access aperture is provided on the cylindrical surface for servicing. A slip ring apparatus is used to route an exterior spark plug cable to the spark plug. Provision is made for rotary valve sealing and lubrication. An optional axial flow compressor is provided at the intake port to deliver combustible gas under pressure to the intake chamber of the rotary valve. Both the axial flow compressor and the rotary valve are powered by a linkage to the output shaft of the engine.

33 Claims, 3 Drawing Sheets

ROTARY VALVE INTERNAL COMBUSTION ENGINE

BACKGROUND OF THE INVENTION

1. Field of the Invention

This invention relates to internal combustion engines and more particularly to an improved rotary valve for internal combustion engines having capacity for a high rate of air flow at all ranges of engine revolutions per minute (R.P.M.), as well as having provision for inclusion of the spark plug within the structure of the rotary valve, an aspiration assistance device, and an advance and retard mechanism.

2. Description of the Prior Art

Internal combustion engines require selective aspiration of the cylinders in order to function properly. During the intake and exhaust strokes of the cycle, aspiration is provided in order that a combustible gas be admitted into the cylinder and the combusted gas be exhausted from the cylinder, respectively. During the compression and power strokes of the cycle, aspiration is prevented in order that the combustible gas be compressed by the piston prior to ignition and expanded against the piston after ignition, respectively.

Conventionally, selective control over aspiration of internal combustion engine cylinders has been almost universally achieved by use of tappet valves. Tappet valves have been favored because of their ability to seal the combustion chamber with a minimum of wear while providing minimal exhaust and lubricant blow-by. Unfortunately, tappet valves require cam shafts, rocker arms, springs, and lifters in order to operate. This complex grouping of parts, all of which require lubrication, adds to the cost of the engine as well as to the chances for a malfunction. Further, a minimum of two tappet valves must be provided for each cylinder, one for the exhaust function and the other for the intake function. Because tappet valves operate by reciprocation, the impact on the valve seat during each cycle frequently results in noisy operation. Noisy operation can also result from the rocker arms and lifters not following properly. Additionally, tappet valves have a large head surface which is separated from the valve seat when aspiration is initiated. The head is oriented perpendicular to the valve seat opening and, consequently, is in the way of exhaust and intake gases, thereby causing gas flow impedance. Finally, tappet valves tend to get very hot during operation of an internal combustion engine because of their continuous presence within the combustion chamber. As a result, they can become red hot and serve as sites for preignition of the combustible gas.

The foregoing problems may be solved by utilizing rotary valves, instead of tappet valves. Because rotary valves rotate rather than reciprocate, operation is noiseless and vibration free. Further, there is no need for a cam shaft, rocker arms, springs, and lifters, thus eliminating their associated problems. Additionally, because there is no head structure on the rotary valve, the aperture for aspiration is clear of interfering objects that may impede gas flow. These benefits result in improved engine efficiency and power. Finally, because the rotary valve rotates rather than reciprocates, it has no portion which is at all times in communication with the combustion chamber. Consequently, no hot spots are present and the preignition problem associated with tappet valves is eliminated.

Rotary valves for internal combustion engines can broadly be classified as being either of a disk type or a drum type. An example of a disk type rotary valve is U.S. Pat. No. 2,648,318 to Bensinger which discloses a single rotating disk having apertures therein for selective control over aspiration of the cylinder. Other examples are U.S. Pat. No. 4,418,658 to DiRoss which discloses a disk type rotary valve for each of the aspiration functions, intake and exhaust, and U.S. Pat. No. 2,444,696 to De La Riestra et al which discloses a disk-like rotary valve having a dome structure.

A drum type rotary valve is generally cylindrically shaped, has apertures on its surface for selective alignment with chamber openings in the engine, and may be oriented either parallel or perpendicular in relation to the axis of the cylinder for the piston. Examples of drum type rotary valves oriented parallel with the cylinder are U.S. Pat. Nos. 1,282,60 to Lindstrom, 2,283,594 to Aspin and 3,130,953 to Carpenter. Examples of drum type rotary valves oriented perpendicular to the cylinder are U.S. Pat. Nos. 1,188,656 to Hoff, 1,692,396 to Tipton, 2,369,147 to Klas, and 2,975,774 to Coffey et al. Further, examples of dual drum type rotary valves which are oriented perpendicular to the cylinder, one being provided for each of the intake and exhaust aspiration functions, are U.S. Pat. Nos. 4,077,382 to Gentile, 4,473,041 to Lyons et al, and 4,545,337 to Lyons et al. A variation in rotary valve structural shape is disclosed in U.S. Pat. No. 2,787,988 to Genet, which teaches a rotary valve having a part spherically shaped portion mated to a cylindrically shaped portion.

U.S. Pat. No. 2,257,846 to Horstman discloses a rotary valve having fuel injectors for a diesel cycle internal combustion engine enclosed in the drum structure.

Widespread use of rotary valves has been hindered by sealing problems, especially as related to lubrication and frictional power loss. Examples of teachings which address this problem area are as follows. U.S. Pat. No. 1,751,986 to Flescher discloses an early solution for lubrication delivery problems by having a plurality of pockets with rollers received therein for oiling the rotary valve. U.S. Pat. No. 3,990,423 to Cross et al discloses lip seals on the rotary valve seat. A head having a separate sealed cap retained by a crossbar keeps the rotary valve on the lip seals during the compression stroke. Finally, U.S. Pat. No. 4,517,938 to Kruger discloses a rotary valve having drive bearings and drive bearing seals. As a result of improvements such as these, combined with the clear advantages of the rotary valve over the tappet valve, rotary valves can now offer superior performance in today's internal combustion engines.

There remains, however, a problem in the art to devise a single rotary valve for each cylinder of an internal combustion engine which provides the inherent operational advantages that tappet valve engine configurations allow, namely, positioning the spark plug at the axial centerline of the cylinder and aspirating the cylinder at the top end thereof. Further, there remains the need in the art to provide an aspiration assistance device for the rotary valve that provides increased aspiration efficiency, resulting in better performance of the engine.

SUMMARY OF THE INVENTION

The present invention provides a drum type rotary valve aspiration control for an internal combustion engine having a single, perpendicularly oriented rotary valve for each cylinder. The rotary valve has separate internal chambers for intake and exhaust aspiration functions, as well as a structure for supporting an internally received spark plug that rotates with the rotary valve during operation.

An internal combustion engine having a conventional piston and crankshaft is provided. At the top of each cylinder and within the cylinder head, a rotary valve is located in perpendicular orientation to the cylinder. An intake and an exhaust port is provided, in straight-line, on either side of the rotary valve along its cylindrical axis. The cylindrical surface of the rotary valve has an aperture for each of the intake and exhaust aspiration functions of the engine. Intake and exhaust apertures are located on the cylindrical surface so as to cooperate with the cylinder port to properly time intake and exhaust aspiration functions with movements of the piston within the cylinder. The rotary valve is separated into two internal chambers, one chamber, having an intake port, communicates with the intake aperture, while the other chamber, having an exhaust port, communicates with the exhaust aperture.

A structure is also provided within the rotary valve for threadably retaining a spark plug. A spark aperture is provided in the cylindrical surface for permitting selective communication between the sparking structure of the spark plug with the cylinder port. A spark plug access aperture is provided on the cylindrical surface, opposite the spark aperture, for entry of an installation and removal tool for replacement of the spark plug. An aperture in the cylinder head, when aligned with the spark plug access aperture, permits entry of an installation and removal tool into the rotary valve structure. The spark aperture is located on the cylindrical surface to provide an optimum axial location for the spark plug in relation to the cylinder port at the time of ignition. An exterior spark plug wire is routed by a stationary contact brush and rotatable slip ring into the interior of the rotary valve and thereupon connects with the spark plug.

An aspiration assistance device may be included with the rotary valve. An axial flow compressor, connected with the intake port, delivers combustible gas under pressure to the intake chamber of the rotary valve. Both the axial flow compressor and the rotary valve are powered by a linkage to the output shaft of the engine.

Rotary valve support loads are transferred to bearings. A rotary valve bushing with built-in graphite wipers, in combination with seal rings for the rotary valve at the intake and exhaust ports, ensures excellent lubricating and sealing qualities for the present invention.

Accordingly, it is an object of the present invention to provide a drum type rotary valve for each cylinder of an internal combustion engine in which the spark plug is removably contained within the rotary valve to ensure optimum combustion performance of the engine.

It is a further object of the present invention to provide a drum type rotary valve which allows for aspiration functions to occur at the top of the cylinder to ensure a high rate of air flow, thereby maximizing engine performance.

It is an additional object of the present invention to provide a drum type rotary valve which allows for aspiration functions to occur at the top of the cylinder and which has improved bearing, lubricating, and sealing qualities.

It is yet a further object of the present invention to provide a drum type rotary valve which allows for aspiration functions at the top of the cylinder and includes an aspiration assistance device to increase power and performance of the engine.

It is still a further object of the present invention to provide a drum type rotary valve having an advance and retard timing mechanism.

It is yet another object of the present invention to provide a drum type rotary valve which is placed either in the head or the block of an internal combustion engine, snap rings retaining the drum type rotary valve thereinto.

It is still a further object of the present invention to provide a water cooling jacket for a drum type rotary valve to ensure long life and efficient operation thereof.

It is yet an additional object of the present invention to provide a drum type rotary valve which has gearing that allows for driving a plurality of drum type rotary valves, one rotary valve for each cylinder, in tandem.

These and other objects and advantages, features, and benefits of the invention will become apparent from the following specification.

DETAILED DESCRIPTION OF THE PREFERRED EMBODIMENT

Figure 1:
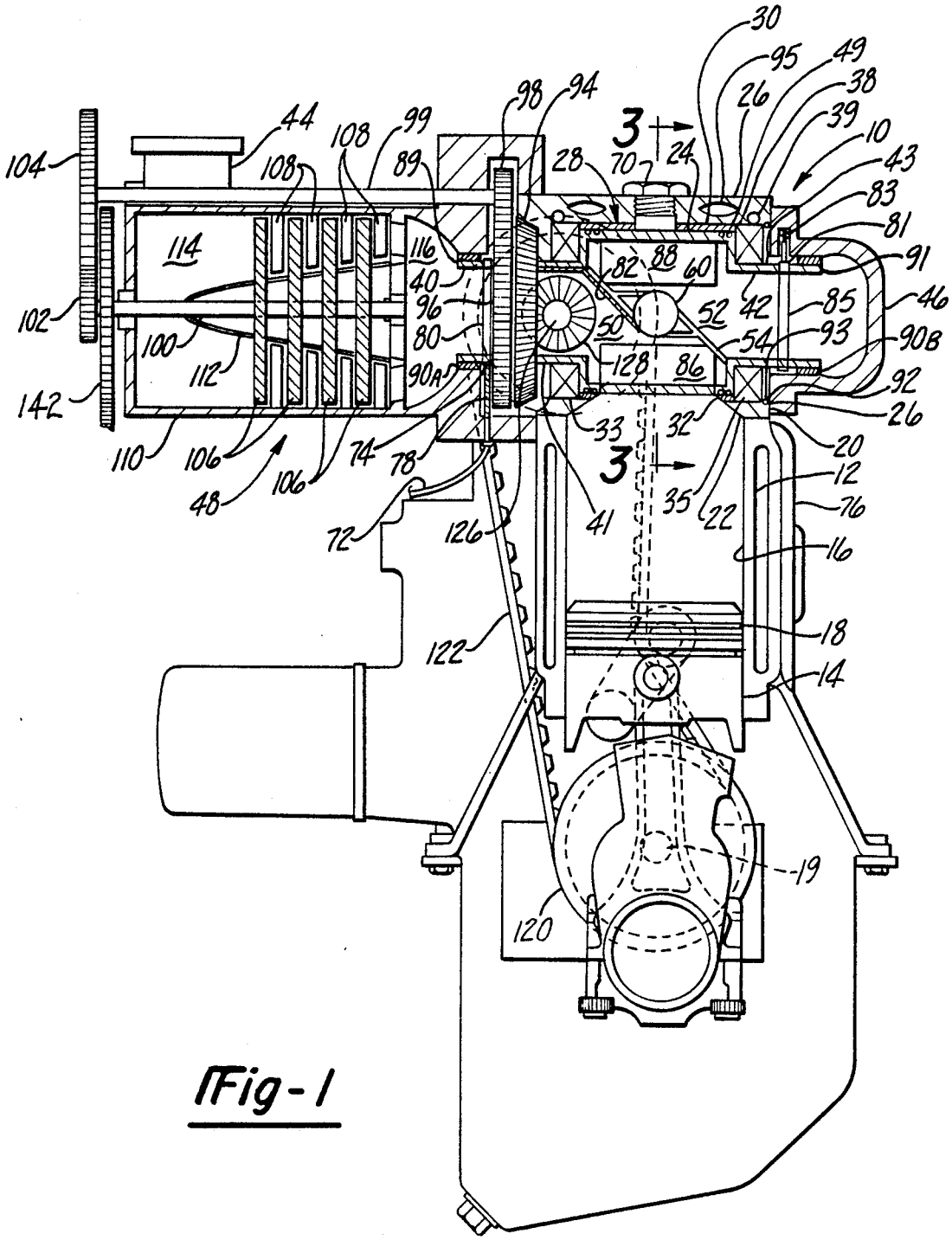
FIG. 1 is a part sectional side view of an internal combustion engine according to the present invention.

Referring now to the figures, FIG. 1 shows the rotary valve system 10 of the present invention which forms a part of an internal combustion engine, located at the top of a cylinder 12 formed in an engine block 76. A piston 14, which reciprocates within the cylinder, sealingly engages the cylinder wall 16 with a plurality of piston rings 18, and is connected to a crankshaft 19 in a conventional manner. The cylinder 12 has a top end 20. A cylinder port 22 of generally rectangular shape is provided at the top end of the cylinder in a cylinder head 26. The cylinder port communicates with a cylindrically shaped cavity 24 in the cylinder head 26. The cylindrically shaped cavity 24 has an orientation which is perpendicular to that of the cylinder 12. Alternatively, the cylindrically shaped cavity 24 and the cylinder port 22 may be either contained in the cylinder head 26 which is removably attached to an engine block 76, as shown, or the cylindrically shaped cavity 24 and the cylinder port 22 may be located directly in the engine block itself, the engine block then serving as the cylinder head.

A drum type rotary valve 28 having a cylindrical wall 30 is received within the cylindrically shaped cavity 24. A bushing 32 is provided on the inner wall surface 25 of the cylindrically shaped cavity 24. Because friction is a problem in rotary valves, the bushing 32 includes graphite wipers 34 to minimize friction with the cylindrical wall 30 of the rotary valve 28. While the bushing 32 serves to seal the rotary valve 28 with respect to the cylindrically shaped cavity 24, it is not supported thereby, as will be explained hereinbelow.

Each end 36 and 38 of the rotary valve 28 communicates with aspiration ports, one 40 for intake and one 42 for exhaust, each rotating with the rotary valve. In FIG. 1, the rotary valve end 36 is integral with the intake port 40, while the rotary valve end 38 is integral with the exhaust port 42. The intake port communicates with an intake manifold 44, while the exhaust port communicates with an exhaust manifold 46. The intake port may contain an axial flow compressor 48, which will be described hereinbelow. Load bearings 33 and 35 are provided on the outer surfaces 41 and 43 of the intake and exhaust ports, respectively. The load bearings ensure very low friction when the rotary valve rotates as well as fixedly centering the rotary valve relative to the cylindrically shaped cavity 24 so that the bushing 32 may seal the rotary valve with virtually no wear. The load bearings are lubricated through oil passages 37 and 39 which are connected to the engine lubrication system in a conventional manner. To protect the load bearings and further to ensure excellent compression quality for the rotary valve 28, a first and second set of ring seals 45 and 47 are provided on the outer surface 64 of the cylinder wall 30 for abutment with the bushing 32.

The interior of the rotary valve 28 is divided into two mutually noncommunicating chambers, an intake chamber 50 and an exhaust chamber 52, by a separation wall 54. The separation wall 54 runs generally diagonally across the interior space formed by the cylindrical wall 30, so that each end 36 and 38 of the rotary valve fully communicates with one or the other of the two chambers.

Figure 3:
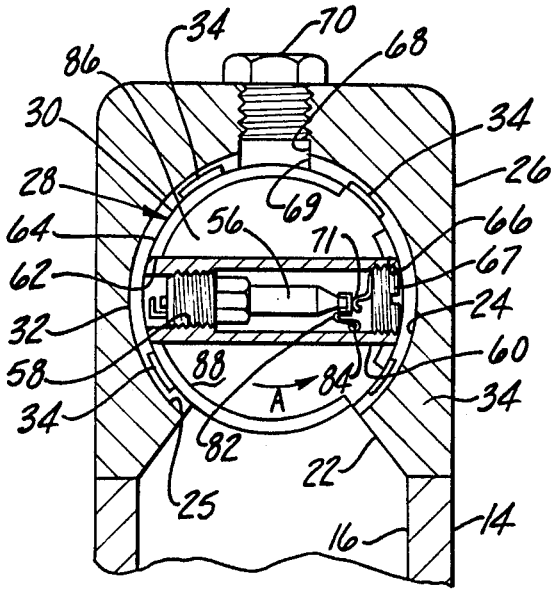
FIG. 3 is a part sectional end view of the internal combustion engine along lines 3—3 in FIG. 1.

As can best be seen from FIG. 3, a spark plug 56 is removably mounted by threads 58 within a spark plug casing 60. A spark aperture 62 is provided in the cylindrical wall 30 so that the spark plug casing may be inserted thereinto just within the outer surface 64 of the cylindrical wall 30. A spark plug access aperture 66 is provided in the cylindrical wall 30, opposite the location of the spark aperture 62, so that the spark plug casing may insert thereinto just within the outer surface 64 of the cylindrical wall 30. The spark plug casing 60 is sealingly mounted to the cylindrical wall 30 at both the spark aperture 62 and spark plug access aperture 66. A removable threaded cap 67 is provided at the end of the spark plug casing adjacent the spark plug access aperture 66 for balancing centrifugal forces caused by rotation of the spark plug 56, since most of its mass is located near the threads 58. The cylinder head 26 and the bushing 32 are provided with a spark plug access cavity 68 and 69, respectively, that are removably sealed by a threaded plug 70. Rotation of the rotary valve 28 is in the direction of arrow A.

An external spark plug wire 72 from the ignition system (not shown) is connected to a first brush 74 which is reciprocably mounted adjacent the intake port 40. The first brush is biased by a spring 78 so that it makes electrical contact with a first slip ring 80. The first slip ring is attached to and electrically insulated from the intake port 40, so that the first slip ring will rotate with the rotary valve 28 but not conduct ignition system electrical energy thereto. An internal spark plug wire 82 is electrically connected at one end to the first slip ring 80, follows the separation wall 54 inside the intake chamber 50, and connects at its other end to the spark plug 56, after sealably passing through an aperture 84 in the spark plug casing 60. The removable threaded cap 67 has a spring clip 71 which serves to retain the internal spark plug wire 82 to the spark plug 56 during rotation. A second brush 81 located adjacent the exhaust port 42 is biased by a spring 83 so as to make electrical contact with a second slip ring 85 which is attached to and electrically conductive with the outer surface 43 of the exhaust port 42. The second brush 81 serves as an electrical ground return path for the spark plug wire electrical circuit. Because electricity is routed from the spark plug via the rotary valve, the exhaust port and the second brush, the bushing 32 is spared from degradation by electrical sparking with the cylindrical wall 30 of the rotary valve. It is possible to further prevent electrical sparking by constructing the rotary valve 28 and its associated intake and exhaust ports, 40 and 42, respectively, out of an electrically nonconductive material, an electrically conductive wire then leading from the ground of the spark plug to the second slip ring. It is further possible to construct the bushing 32 out of an electrically nonconductive material as well.

An intake aperture 86 and an exhaust aperture 88 are provided in the cylindrical wall 30. Both the intake and exhaust apertures are substantially rectangular in shape. The intake aperture 86 opens directly into the intake chamber 50, while the exhaust aperture 88 opens directly into the exhaust chamber 52. The intake and exhaust apertures 86 and 88 are disposed in relation to the spark aperture 62 and the cylinder port 22 so that the engine will run in a smooth and efficient manner. As can best be seen from FIG. 3, the intake and exhaust apertures 86 and 88 are disposed on either side of the spark aperture 62, and are farther therefrom than from the spark plug access aperture 66. This placement is to properly time aspiration in relation to piston movement, thereby providing for aspiration only during the exhaust and intake strokes of the engine cycle. The intake and exhaust apertures 86 and 88 are further disposed in relation to one another and the cylinder port 22 so that at the end of the exhaust stroke, intake gases can flow into the cylinder and out the exhaust manifold. Thus, combusted gases in the cylinder may be scavenged therefrom. Particularly, the large size of the intake and exhaust apertures 86 and 88, coupled with the large size of the intake and exhaust ports 40 and 42, allow for a large volume of air flow.

Figure 2:
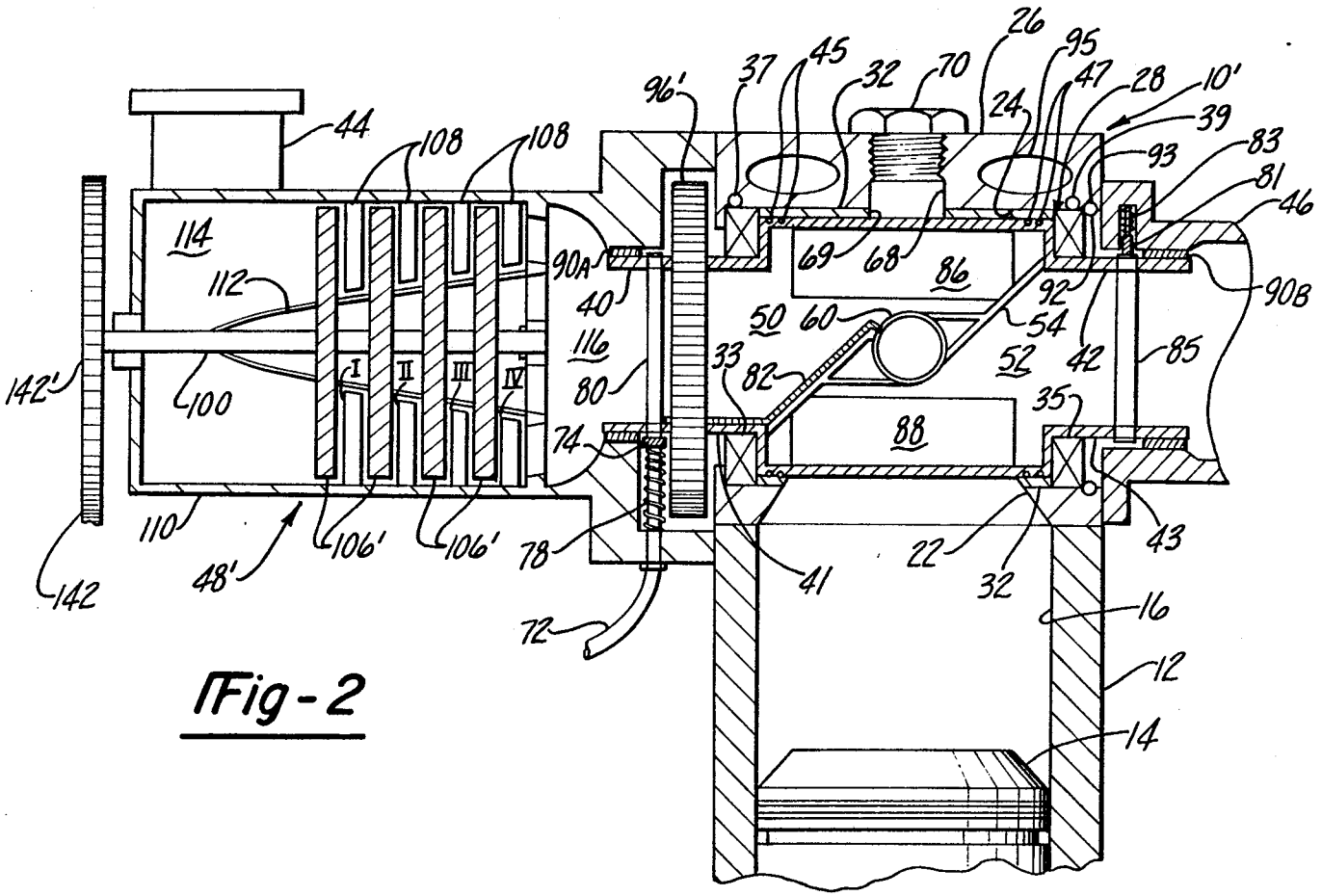
FIG. 2 is a part sectional detailed side view of a rotary valve system according to the present invention.

A first seal 90A is provided at the end 89 of the intake port 40 between the intake manifold 44 and the intake port 40. FIGS. 1 and 2 show the seal 90A abutting the optional axial flow compressor, which, in turn, is connected to the intake manifold. A second seal 90B is provided at the end 91 of the exhaust port 42 between the exhaust manifold 46 and the exhaust port 42.

The rotary valve 28, with its integral intake and exhaust ports 40 and 42, is removably held in the cylindrically shaped cavity 24 by a snap ring 92 which is removably retained in a groove 93 in the cylinder head 26 adjacent the load bearing 35. The snap ring facilitates installation and removal of the rotary valve from the engine.

A water jacket 95 is provided in the housing of the rotary valve to ensure cool and efficient operation. The water jacket is connected to the engine water cooling system in a conventional manner.

The rotary valve shown in FIG. 1 is caused to rotate by a bevel ring gear 94 connected with the engine crankshaft 19 from the engine in a manner to be elaborated hereinbelow. The bevel ring gear 94 is connected to the outer surface 41 of the intake port 40. Rotation of the bevel ring gear is thereby transmitted to the rotary valve 28. A ring gear 96, is also connected to the intake port 40 and gearingly meshes with a first pinion gear 98 which drives a rotary valve drive shaft 99. The rotation rate is adjusted so that the location of the spark, intake and exhaust apertures of the rotary valve pass the cylinder port at the correct times relative to the movement of the piston within the cylinder to provide smooth and efficient operation of the engine.

The rotary valve shown in FIG. 1 includes an optional axial flow compressor 48 which is mounted integrally with the intake port 40. This is used to compress the intake combustible gas 114 so that a higher density of combustible gas can be delivered to the cylinder during the intake stroke, thereby boosting energy output of the engine. Turbo-chargers are finding increasing acceptance by automotive manufacturers because they can deliver a high torque engine output without the need to attendantly increase cubic inch displacement of the engine. The axial flow compressor 48 has a blade shaft 100 connected at one end to a second pinion gear 102 which meshes with a third pinion gear 104 connected to the rotary valve drive shaft 99, thereby driving the axial flow compressor 48. The blade shaft 100 also carries a fourth pinion gear 142 to communicate with an adjacent rotary valve if more than one valve is contemplated as later described herein. A plurality of rotor blades 106 are connected to the blade shaft 100 and cooperate with stator blades 108 and a cone shaped structure 112, to generate a turbine compression of the combustible gas 114 when the rotor blades rotate. Any number of turbine stages may be used, FIGS. 1 and 2 showing four turbine stages I, II, III and IV. The stator blades 108 are attached to the housing 110 of the axial flow compressor and the cone shaped structure is attached to the blade shaft 100. The combustible gas 114 is thereby pressurized into a compression chamber 116, the intake port 40 and the intake chamber 50, awaiting initiation of the intake stroke. It is contemplated within the scope of the disclosure herein that the axial flow compressor may be integral with and be a part of the intake port. Further, it is also contemplated within the scope of the disclosure herein to utilize a single axial flow compressor within the intake manifold in order to service multiple cylinders.

Figure 4:
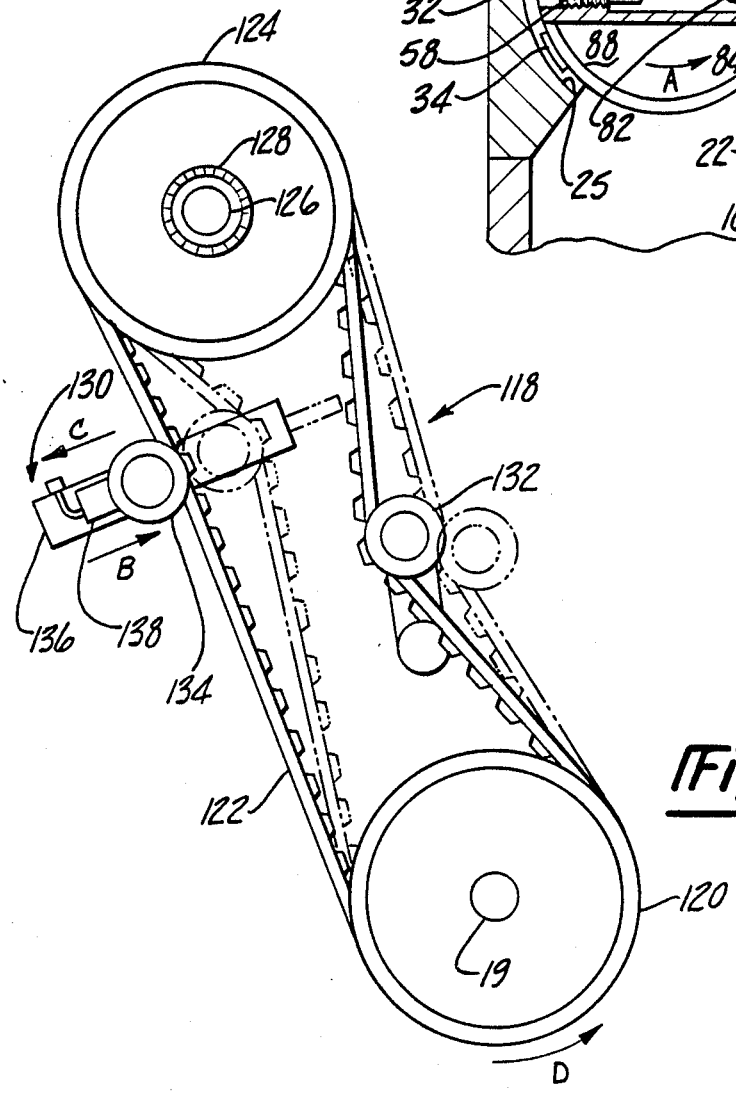
FIG. 4 is a side view of the advance and retard mechanism according to the present invention.

An advance and retard mechanism 118 is provided, which is particularly shown in FIG. 4. A pulley 120 on the engine crankshaft 19 drives, via a belt or chain 122 a second pulley 124 on a shaft 126 on which a bevel gear 128 rotates (as shown in FIG. 1). The bevel gear 128 meshes with the bevel ring gear 94 to cause rotation of the rotary valve and axial flow compressor. Advancement and retardation of the rotary valve timing is achieved by a servo-mechanism 130 in combination with an idler pulley 132. The servo-mechanism is controlled preferably by an engine computer which tabulates load conditions with engine R.P.M.'s in a conventional manner. Alternatively, engine intake vacuum pressure can be used to actuate the servo-mechanism. The servo-mechanism has a slide pulley 134 which is reciprocably movable on a base 136. In response to actuation of the servo-mechanism, a piston-cylinder 138 in the servo-mechanism causes the slide pulley to be selectively moved further toward the belt or chain to the position shown in phantom in FIG. 4. When the slide pulley is moved as described, the idler pulley 132, which is biased against the belt or chain 122, is caused to be displaced to the location shown in phantom in FIG. 4. Accordingly, timing of the rotary valve is adjusted to advance timing when the slide pulley 134 is moved toward the belt or chain 122, along arrow B, and to retard timing when the slide pulley is moved away from the belt or chain, along arrow C, where arrow D defines the direction of rotation of the pulley 120.

Operation of the rotary valve according to the present invention is as follows. When the engine is cranked, the piston is caused to reciprocate, combustible gas is delivered to the intake chamber from the intake manifold, the rotary valve rotates, and spark energy is delivered to the spark plug from the ignition system each time the spark aperture coincides with the cylinder port.

Starting the operational description when the piston 14 is at the top of its stroke, the intake stroke initiates as the piston starts to descend in the cylinder 12. The rotary valve 28 is in an angular orientation so that the intake aperture 86 begins communication with the cylinder port 22, and combustible gas 114 enters the cylinder as the piston descends. At the conclusion of the intake stroke, when the piston is at its lowest point of travel, the intake aperture has rotated away from the cylinder port, closing off the cylinder, as shown in FIGS. 1 and 2. The piston now ascends, beginning the compression stroke. As the piston ascends to the top of its stroke, the spark aperture 62 begins communication with the cylinder port. When the piston has reached the top of its compression stroke, the spark aperture is directly over the piston, at a central position above the cylinder. The ignition system delivers an electrical pulse to the spark plug, triggering a spark. Combustion of the compressed combustible gas ensues, forcing the cylinder downward thereby commencing the power stroke. As the piston reaches the lowest point of its travel, concluding the power stroke, the exhaust aperture 88 rotates into communication with the cylinder. As the piston ascends, the combusted gases exit into the exhaust manifold. When the exhaust stroke is completed, the cycle repeats as hereinabove recounted. The advance and retard mechanism is pre-adjusted to time the aspiration of the engine cylinder for various conditions of operation and R.P.M.'s.

It is important to note that the above description may or may not include the use of the axial flow compressor 48. When the axial flow compressor is used, higher density of combustible gas will be delivered to the cylinder during the intake stroke, but operation will otherwise remain the same.

While the foregoing preferred embodiment has addressed the structure and operation of a single rotary valve according to the present invention, it is clear that the present invention is intended to be used particularly in multicylinder internal combustion engines. Such additional rotary valves having the same structure as hereinabove described are shown in FIG. 2.

Referring now to FIG. 2, similar components to those discussed hereinabove for FIG. 1 will each have the same reference numeral, while components which are changed will each be designated by the same reference numeral including a prime. FIG. 1 represents a rotary valve system 10 which is driven from the crankshaft 19 in the manner hereinabove described. FIG. 2 represents a second rotary valve system 10' which is driven in tandem from the rotary valve system 10 of FIG. 1. Accordingly, the rotary valve system of FIG. 1 shall be designated the first rotary valve system, and the rotary valve system of FIG. 2 shall be designated the second rotary valve system. It will be seen from FIG. 2 that essentially all the rotary valve system components shown in FIG. 2 are identical to those hereinabove described for FIG. 1 and, accordingly, these will not be further discussed. The rotary valve system of FIG. 2 shows the rotary valve 28 in an orientation when the piston 14 is at the end of the power stroke.

A ring gear 96' is connected to the outer surface of the intake port 40 of the second rotary valve system. The ring gear 96' of the second rotary valve system gearing meshes with the ring gear 96 of the first rotary valve system. Thus, the rotary valve 28 of the second rotary valve system 10' rotates in an opposite direction to that of the rotary valve 28 in the first rotary valve system 10. Any number of additional rotary valve systems may be added, in tandem, by gearingly meshing, in succession, the ring gear 96' of each successive secondary rotary valve system.

The axial flow compressor 48' of the second rotary valve system 10' has a pinion gear 142' which meshes with the fourth pinion gear 142 of the axial flow compressor 48 of the first rotary valve system 10. However, because the axial flow compressor 48' of the second rotary valve system is driven by the axial flow compressor of the first rotary valve system, the axial flow compressor 48' will rotate oppositely to the direction of the axial flow compressor 48. Accordingly, the turbine blades 106' of the axial flow compressor 48' are oppositely slanted to the turbine blades 106 of the axial flow compressor 48. Any number of additional rotary valves having an axial flow compressor may be added, in tandem, by gearingly meshing, in succession, the pinion gear 142' of each successive secondary rotary valve system, the turbine blades being in reverse slant for each successive rotary valve system axial flow compressor.

To those skilled in the art to which this invention appertains, the above described preferred embodiment may be subject to change or modification. Such changes or modifications can be carried out without departing from the scope of the invention, which is intended to be limited only by the scope of the appended claims.

What is claimed is:

1. A rotary valve internal combustion engine, comprising:

an engine block;

at least one cylinder in said engine block, said at least one cylinder having a top end;

cylinder head means located adjacent said top end of said at least one cylinder, said cylinder head means having a cylindrically shaped cavity therein, said cylindrically shaped cavity being oriented in perpendicular relation to said at least one cylinder;

a piston sealingly mounted in said at least one cylinder for reciprocable movement therein, said reciprocable movement including an intake stroke and an exhaust stroke;

engine shaft means rotatably mounted to said engine block;

means within said engine block for converting said reciprocable movement of said piston into rotary motion of said engine shaft means;

a cylinder port located at said top end of said at least one cylinder;

a rotary valve rotatably mounted in said cylindrically shaped cavity;

means connected with said engine shaft means for rotating said rotary valve in a predetermined synchronization with said reciprocable movement of said piston;

aspiration means in said rotary valve for selectively aspirating said at least one cylinder during said intake and exhaust strokes;

a spark plug removably mounted within said rotary valve and rotatable therewith;

means connected to said rotary valve and said cylinder head means for removably mounting said spark plug within said rotary valve;

means adjacent said engine block and connected to said rotary valve for selectively supplying electrical impulses to said spark plug to cause said spark plug to spark; and means on said rotary valve for providing selective access by said spark of said spark plug into said cylinder port.

2. The rotary valve internal combustion engine of claim 1, wherein said rotary valve includes a cylindrical wall, said cylindrical wall having a first end and a second end, said cylindrical wall further having an intake aperture and an exhaust aperture.

3. The rotary valve internal combustion engine of claim 2, wherein said rotary valve internal combustion engine has an intake manifold adjacent said engine block and an exhaust manifold adjacent said engine block and wherein, said aspiration means further comprises:

an intake port connected with said rotary valve and rotatable therewith, said intake port having a first end and a second end, said first end of said intake port communicating with said intake manifold;

an exhaust port connected with said rotary valve and rotatable therewith, said exhaust port having a first end and a second end, said first end of said exhaust port communicating with said exhaust manifold; and separation means mounted within said cylindrical wall of said rotary valve for providing an intake chamber and an exhaust chamber, said intake and exhaust chambers being in mutually noncommunicating relationship, said separation means further providing said first end of said cylindrical wall communication with said second end of said intake port, said separation means further providing said second end of said cylindrical wall communication with said second end of said exhaust port; said intake aperture of said cylindrical wall communicating with said intake chamber and selectively communicating with said cylinder port; said exhaust aperture of said cylindrical wall communicating with said exhaust chamber and selectively communicating with said cylinder port.

4. The rotary valve internal combustion engine of claim 3, wherein said means for removably mounting said spark plug comprises:

a spark plug casing mounted to said cylindrical wall at a first location and at a second opposite location, said first location having a spark aperture in said cylindrical wall, said second opposite location having a spark plug access aperture in said cylindrical wall;

means on said spark plug casing for threadably mounting said spark plug within said plug casing; and a threaded plug removably mounted to said cylinder head means; said cylinder head means having a spark plug access cavity into which said thread plug is received.

5. The rotary valve internal combustion engine of claim 4, wherein said means for selectively supplying electrical impulses to said spark plug, comprises:

an ignition system adjacent said engine block, said ignition system having an electrical ground;

an external spark plug wire having a first end and a second end, said first end of said spark plug wire being electrically connected to said ignition system;

a first brush electrically connected to said second end of said external spark wire;

a first slip ring mounted to rotate with said rotary valve, said first slip ring being electrically insulated from said rotary valve;

means adjacent said rotary valve for biasing said first brush against said first slip ring;

a second brush electrically connected to said electrical ground of said ignition system;

a second slip ring mounted to rotate with said rotary valve, said second slip ring being electrically connected to said electrical ground of said spark plug;

means adjacent said rotary valve for biasing said second brush against said second slip ring;

an internal spark plug wire having a first end and a second end, said first end of said internal spark plug wire being electrically connected to said first slip ring, said second end of said internal spark plug wire being electrically connectable with said spark plug; and means on said spark plug casing for sealably introducing said second end of said internal spark plug wire into said spark plug casing.

6. The rotary valve internal combustion engine of claim 5, further comprising means with said rotary valve for sealing said rotary valve.

7. The rotary valve internal combustion engine of claim 6, further comprising advance and retard means connected with said engine shaft means for adjusting timing of when said intake and exhaust apertures communicate with said cylinder port.

8. The rotary valve internal combustion engine of claim 7, further comprising snap ring means located adjacent said cylinder head means for releasably retaining said rotary valve within said cylindrically shaped cavity.

9. The rotary valve internal combustion engine of claim 8, further comprising bearing means located adjacent said rotary valve for rotatably mounting said rotary valve within said cylindrically shaped cavity.

10. The rotary valve internal combustion engine of claim 9, further comprising means located adjacent said rotary valve for lubricating said rotary valve.

11. The rotary valve internal combustion engine of claim 10, further comprising water jacket means located in said cylinder head means for cooling said rotary valve.

12. The rotary valve internal combustion engine of claim 11, further comprising means associated with said rotary valve for scavenging combusted gases from said at least one cylinder when said exhaust stroke is concluding and said intake stroke is commencing.

13. The rotary valve internal combustion engine of claim 12, wherein said means for rotating said rotary valve includes means for rotating more than one said rotary valve.

14. The rotary valve internal combustion engine of claim 12, further comprising:

an axial flow compressor having a plurality of rotatable blades, said axial flow compressor having at least one turbine stage, said axial flow compressor further having a first end and a second end, said first end of said axial flow compressor being connected to said intake manifold, said second end of said axial flow compressor being connected to said intake port; and means adjacent said engine block for rotating said plurality of rotatable blades of said axial flow compressor.

15. The rotary valve internal combustion engine of claim 14, wherein said means for rotating said rotatable blades includes means for rotating said rotatable blades of more than one axial flow compressor.

16. A rotary valve for an internal combustion engine, said internal combustion engine having an engine block, at least one cylinder in said engine block, engine shaft means rotatably mounted to said engine block, a piston sealingly mounted in said at least one cylinder for reciprocable movement therein, means for converting said reciprocable movement of said piston to rotary movement of said engine shaft means, said piston having an intake and an exhaust stroke, said rotary valve comprising:

cylinder head means located adjacent one end of said at least one cylinder, said cylinder head means having a cylindrically shaped cavity therein, said cylindrically shaped cavity being oriented in perpendicular relation to said at least one cylinder;

a cylinder port located at said one end of said at least one cylinder;

a rotary valve rotatably mounted in said cylindrically shaped cavity;

means connected with said engine shaft means of said internal combustion engine for rotating said rotary valve in a predetermined synchronization with said reciprocable movement of said piston;

aspiration means in said rotary valve for selectively aspirating said at least one cylinder during said intake and exhaust strokes;

a spark plug removably mounted within said rotary valve and rotatable therewith;

means connected to said rotary valve and said cylinder head means for removably mounting said spark plug within said rotary valve;

means adjacent said engine block and connected to said rotary valve for selectively supplying electrical impulses to said spark plug to cause said spark plug to spark; and means on said rotary valve for providing selective access by said spark of said spark plug to said cylinder port.

17. The rotary valve for an internal combustion engine of claim 16, wherein said rotary valve includes a cylindrical wall, said cylindrical wall having a first end and a second end, said cylindrical wall further having an intake aperture and an exhaust aperture.

18. The rotary valve for an internal combustion engine of claim 17, wherein said internal combustion engine further includes an intake manifold adjacent said engine block and an exhaust manifold adjacent said engine block, said aspiration means comprising:

an intake port connected with said rotary valve and rotatable therewith, said intake port having a first end and a second end, said first end of said intake port communicating with said intake manifold;

an exhaust port connected with said rotary valve and rotatable therewith, said exhaust port having a first end and a second end, said first end of said exhaust port communicating with said exhaust manifold; and separation means mounted within said cylindrical wall of said rotary valve for providing an intake chamber and an exhaust chamber, said intake and exhaust chambers being in mutually noncommunicating relationship, said separation means further providing said first end of said cylindrical wall communication with said second end of said intake port, said separation means further providing said second end of said cylindrical wall communication with said second end of said exhaust port; said intake aperture of said cylindrical wall communicating with said intake chamber and selectively communicating with said cylinder port; said exhaust aperture of said cylindrical wall communicating with said exhaust chamber and selectively communicating with said cylinder port.

19. The rotary valve for an internal combustion engine of claim 18, wherein said means for removably mounting said spark plug comprises:

a spark plug casing mounted to said cylindrical wall at a first location and at a second opposite location, said first location having a spark aperture in said cylindrical wall, said second opposite location having a spark plug access aperture in said cylindrical wall;

means on said spark plug casing for threadably mounting said spark plug within said spark plug casing; and a threaded plug removably mounted to said cylinder head means; said cylinder head means having a spark plug access cavity into which said threaded plug is received.

20. The rotary valve for an internal combustion engine of claim 19, wherein said means for selectively supplying electrical impulses to said spark plug, comprises:

an ignition system adjacent said engine block, said ignition system having an electrical ground;

an external spark plug wire having a first end and a second end, said first end of said spark plug wire being electrically connected to said ignition system;

a first brush electrically connected to said second end of said external spark plug wire;

a first slip ring mounted to rotate with said rotary valve, said first slip ring being electrically insulated from said rotary valve;

means adjacent said rotary valve for biasing said first brush against said first slip ring;

a second brush electrically connected to said electrical ground of said ignition system;

a second slip ring mounted to rotate with said rotary valve, said second slip ring being electrically connected to said electrical ground of said spark plug;

means adjacent said rotary valve for biasing said second brush against said second slip ring;

an internal spark plug wire having a first end and a second end, said first end of said internal spark plug wire being electrically connected to said first slip ring, said second end of said internal spark plug wire being electrically connectable with said spark plug; and means on said spark plug casing for sealably introducing said second end of said internal spark plug wire into said spark plug casing.

21. The rotary valve for an internal combustion engine of claim 20, further comprising means with said rotary valve for sealing said rotary valve.

22. The rotary valve for an internal combustion engine of claim 21, further comprising advance and retard means connected with said engine shaft means for adjusting timing of when said intake and exhaust apertures communicate with said cylinder port.

23. The rotary valve for an internal combustion engine of claim 22, further comprising snap ring means located adjacent said cylinder head means for releasably retaining said rotary valve within said cylindrically shaped cavity.

24. The rotary valve for an internal combustion engine of claim 23, further comprising bearing means located adjacent said rotary valve for rotatably mounting said rotary valve in said cylindrically shaped cavity.

25. The rotary valve for an internal combustion engine of claim 24, further comprising means located adjacent said rotary valve for lubricating said rotary valve.

26. The rotary valve for an internal combustion engine of claim 25, further comprising water jacket means in said cylinder head means for cooling said rotary valve.

27. The rotary valve for an internal combustion engine of claim 26, further comprising means associated with said rotary valve for scavenging combusted gases from said at least one cylinder when said exhaust stroke is concluding and said intake stroke is commencing.

28. The rotary valve for an internal combustion engine of claim 27, wherein said means for rotating said rotary valve includes means for rotating more than one said rotary valve.

29. The rotary valve for an internal combustion engine of claim 27, further comprising:

an axial flow compressor having a plurality of rotatable blades, said axial flow compressor having at least one turbine stage, said axial flow compressor further having a first end and a second end, said first end of said axial flow compressor being connected to said intake manifold, said second end of said axial flow compressor being connected to said intake port; and means adjacent said engine block for plurality of rotating said rotatable blades of said axial flow compressor.

30. The rotary valve for an internal combustion engine of claim 28, wherein said means for rotating said rotatable blades includes means fo rotating said plurality of rotatable blades of more than one of said axial compressor.

31. A rotary valve aspiration system for an internal combustion engine, said internal combustion engine having an engine block, at least one cylinder in said engine block, engine shaft means rotatably mounted to said engine block, a piston sealingly mounted in said at least one cylinder for reciprocable movement therein, means for converting said reciprocable movement of said piston to rotary movement of said engine shaft means, said piston having an intake stroke and an exhaust stroke, said internal combustion engine further having an intake manifold adjacent said engine block and an exhaust manifold adjacent said engine block, said rotary valve aspiration system comprising:

cylinder head means located adjacent one end of said at least one cylinder, said cylinder head means having a cylindrically shaped cavity therein, said cylindrically shaped cavity being oriented in perpendicular relation to said at least one cylinder;

a cylinder port at said one end of said at least one cylinder;

a rotary valve rotatably mounted in said cylindrically shaped cavity, said rotary valve including a cylindrical wall, said cylindrical wall having a first end and second end, said cylindrical wall further having an intake aperture and an exhaust aperture;

means with said rotary valve for sealing and rotary valve;

means having connection with said engine shaft means of said internal combustion engine for rotating said rotary valve in a predetermine synchronization with said reciprocable movement of said piston;

aspiration means in aid rotary valve for selectively aspirating said at least one cylinder during said intake and exhaust stroke said aspiration means comprising:

an intake port connected with said rotary valve and rotatable therewith, said intake port having a first end and a second end, said first end of said intake port communicating with said intake manifold;

an exhaust port connected with said rotary valve and rotatable therewith, said exhaust port having a first end and a second end, said first end of said exhaust port communicating with said exhaust manifold; and separation means mounted within said cylindrical wall of said rotary valve for providing an intake chamber and an exhaust chamber, said intake and exhaust chambers being in mutually noncommunicating relationship, said separation means further providing said first end of said cylindrical wall communication with said second end of said intake port, said separation means further providing said second end of said cylindrical wall communication with said second end of said exhaust port; said intake aperture of said cylindrical wall communicating with said intake chamber an selectively communicating with said cylinder port; said exhaust aperture of said cylindrical wall communicating with said exhaust chamber and selective communicating with said cylinder port;

a spark plug removably mounted within said rotary valve and rotatable therewith;

means connected to said rotary valve and said cylinder head means for removably mounting said spark plug within said rotary valve;

means adjacent said engine block and connected to said rotary valve for selectively supplying electrical impulses to said spark plug to cause said spark plug to spark;

means on said rotary valve for providing selective access by said spark of said spark plug to said cylinder port;

an axial flow compressor having a plurality of rotatable blades, said axial flow compressor having at least one turbine stage, said axial flow compressor further having a first end and a second end, said first end of said axial flow compressor being connected to said intake manifold, said second end of said axial flow compressor being connected to said intake port; and means adjacent said engine block for rotating said plurality of rotatable blades of said axial flow compressor.

32. An axial flow compressor for an internal combustion engine, said internal combustion engine including an engine shaft and an intake manifold for delivering intake gas to said axial flow compressor, said internal combustion engine having at least one aspiration control, said axial flow compressor comprising:

a housing, said housing having a first end and a second end, said first end of said housing communicating with said intake manifold, said second end of said housing communicating with said at least one aspiration control, said housing further having an inner surface;

a blade shaft rotatably mounted to said housing;

means connected with said engine shaft for rotating said blade shaft;

at least one turbine stage, said at least one turbine stage comprising:

a plurality of rotatable blades within said housing, said plurality of rotatable blades being connected to said blade shaft;

a cone structure within said housing, said cone structure being mounted to said blade shaft; and a plurality of stator blades mounted to said inner surface of said housing, said plurality of stator blades cooperating with said plurality of rotatable blades and said cone structure to produce a turbine compression of said intake gas when said engine shaft rotates; and a compression chamber located at said second end of said housing.

33. An advance and retard mechanism for at least one aspiration control of an internal combustion engine, said internal combustion engine including an engine shaft, said advance and retard mechanism comprising:

actuation means connected with said engine shaft for actuating said at least one aspiration control, said actuation means including a flexible drive means, said flexible drive means having a portion thereof under tension when said engine shaft rotates, said flexible drive means further having a portion under compression when said engine shaft rotates;

a servo-mechanism connected with said engine block, said servo-mechanism comprising:

a base having connection with said engine block;

a piston-cylinder apparatus having a reciprocable piston therein, said reciprocable piston having a piston rod attached thereto;

a slide pulley attached to said piston rod, said piston-cylinder apparatus causing said slide pulley to bias with a predetermined force against said portion of said flexible drive means under tension; and means responsive to operational conditions of said engine for actuating said piston cylinder apparatus in order to cause said slide pulley to bias against said flexible drive means with a predetermined force;

a second base having connection with said engine block; and an idler pulley reciprocably and resiliently mounted to said second base, said idler pulley biasing against said portion of said flexible drive means under compression.

* * * * *

UNITED STATES PATENT AND TRADEMARK OFFICE

CERTIFICATE OF CORRECTION

PATENT NO. : 4,815,428

DATED : March 28, 1989

INVENTOR(S) : Paul H. Bunk

It is certified that error appears in the above-identified patent and that said Letters Patent is hereby corrected as shown below:

Column 2, line 18, delete "1,282,60" and insert ---- 1,282,602 ----.

Column 10, line 60, after "said" (second occurrence) insert ---- spark ----.

Column 10, line 64, delete "thread" and insert ---- threaded ----.

Column 14, line 42, after "for" insert ---- rotating said ----.

Column 14, line 43, delete "rotating said".

Column 14, line 47, delete "fo" and insert ---- for ----.

Column 15, line 13, delete "predetermine" and insert ---- predetermined ----.

Column 15, line 16, delete "aid" and insert ---- said ----.

Column 15, line 18, delete "stroke" and insert ---- strokes ----.

UNITED STATES PATENT AND TRADEMARK OFFICE

CERTIFICATE OF CORRECTION

PATENT NO. : 4,815,428

DATED : March 28, 1989

INVENTOR(S) : Paul H. Bunk

It is certified that error appears in the above-identified patent and that said Letters Patent is hereby corrected as shown below:

Column 15, line 41, delete "an" and insert ---- and ----.

Column 15, line 45, delete "selective" and insert ---- selectively ----.

Figure 3, please correct reference numeral 86 to 88 and 88 to 86 as indicated on the attached sheet.

Signed and Sealed this

Twenty-seventh Day of February, 1990

*Attest:*

JEFFREY M. SAMUELS

*Attesting Officer*

*Acting Commissioner of Patents and Trademarks*

UNITED STATES PATENT AND TRADEMARK OFFICE

CERTIFICATE OF CORRECTION

PATENT NO. : 4,815,428

DATED : March 28, 1989

INVENTOR(S) : Paul H. Bunk

It is certified that error appears in the above-identified patent and that said Letters Patent is hereby corrected as shown below:

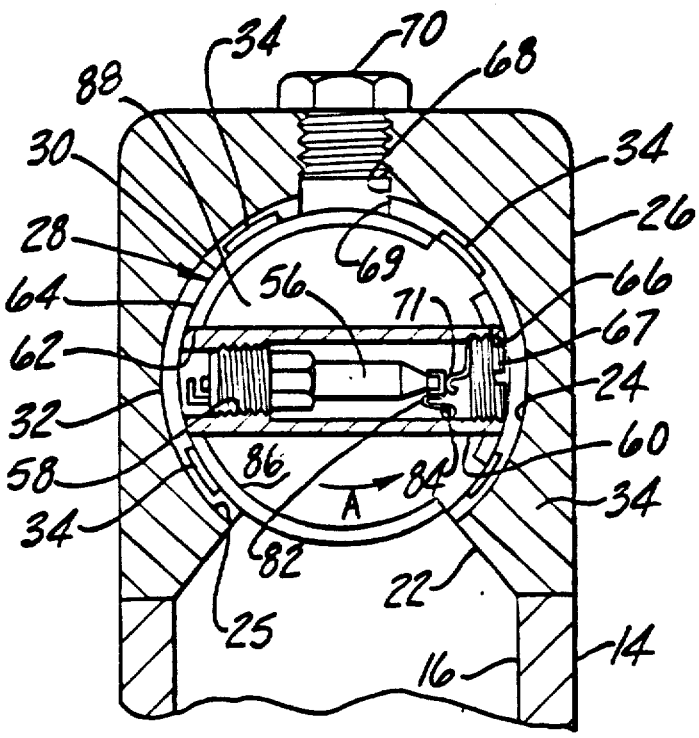

Fig-3